US008567071B2

(12) United States Patent
Strauss

(10) Patent No.: US 8,567,071 B2
(45) Date of Patent: Oct. 29, 2013

(54) UTILITY KNIFE

(75) Inventor: Ralf Strauss, Huntersville, NC (US)

(73) Assignee: Irwin Industrial Tool Company, Huntersville, NC (US)

( * ) Notice: Subject to any disclaimer, the term of this patent is extended or adjusted under 35 U.S.C. 154(b) by 359 days.

(21) Appl. No.: 12/858,023

(22) Filed: Aug. 17, 2010

(65) Prior Publication Data

US 2012/0042523 A1 Feb. 23, 2012

(51) Int. Cl.
*B26B 21/10* (2006.01)

(52) U.S. Cl.
USPC ..... 30/162; 30/335; 30/337

(58) Field of Classification Search
USPC ..... 30/162–164, 335–340, 342
See application file for complete search history.

(56) References Cited

U.S. PATENT DOCUMENTS

| | | | | |
|---|---|---|---|---|
| 4,575,940 | A | 3/1986 | Wenzel | |
| 4,586,256 | A | 5/1986 | Weimann | |
| 5,022,156 | A | 6/1991 | Kallens et al. | |
| 5,025,558 | A | 6/1991 | Gilbert | |
| 5,121,544 | A * | 6/1992 | Gilbert | 30/162 |
| D352,881 | S | 11/1994 | Schmidt | |
| D426,133 | S | 6/2000 | Degen et al. | |
| 6,192,589 | B1 * | 2/2001 | Martone et al. | 30/125 |
| 6,223,439 | B1 | 5/2001 | Wonderley | |
| 6,249,975 | B1 * | 6/2001 | Lin | 30/162 |
| 6,263,577 | B1 * | 7/2001 | Wonderley | 30/152 |
| D453,461 | S | 2/2002 | Chen | |
| 6,415,514 | B1 * | 7/2002 | Chun | 30/162 |
| D462,250 | S | 9/2002 | Ping | |
| 6,532,670 | B1 | 3/2003 | Berns | |
| 6,752,054 | B2 | 6/2004 | Knight | |
| 6,829,827 | B2 | 12/2004 | Tseng | |
| D508,839 | S | 8/2005 | Brown et al. | |
| D510,010 | S | 9/2005 | Brown et al. | |
| D511,288 | S | 11/2005 | Brown et al. | |
| D511,447 | S | 11/2005 | Brown et al. | |
| D520,327 | S | 5/2006 | Gist et al. | |
| 7,131,204 | B2 | 11/2006 | Brown et al. | |
| 7,316,070 | B2 | 1/2008 | Green | |
| 7,739,799 | B2 * | 6/2010 | Van Deursen | 30/142 |
| 7,814,664 | B2 | 10/2010 | LeBlanc et al. | |
| 2002/0029480 | A1 * | 3/2002 | Lin | 30/125 |
| 2010/0126024 | A1 * | 5/2010 | Price | 30/162 |
| 2010/0325899 | A1 * | 12/2010 | Seber et al. | 30/162 |

OTHER PUBLICATIONS

U.S. Appl. No. 12/858,013, filed Aug. 17, 2010.
U.S. Appl. No. 12/858,019, filed Aug. 17, 2010.
U.S. Patent and Trademark Office, U.S. Appl. No. 12/858,019, Office Action, Dec. 7, 2012.

* cited by examiner

*Primary Examiner* — Katherine Mitchell
*Assistant Examiner* — Daniel Cahn
(74) *Attorney, Agent, or Firm* — Dennis J. Williamson; Moore & Van Allen PLLC

(57) ABSTRACT

A utility knife comprises a blade carrier movable between retracted, extended and positions. A latch is movable with the blade carrier for locking the blade carrier in position. The blade carrier comprises a locking tab movable between a first position where the locking tab is engaged with the blade and a second position where the locking tab is released from the blade. An actuator moves the locking tab from the first position to the second position when the blade carrier is in the intermediate position and the actuator is moved to the unlocked position. The latch is engageable with a holder when the blade carrier is in the intermediate position. A retention member holds the blade on the plate where the retention member cannot be inserted into a notch on the blade. A blade guide guides the blade between the retention member and the plate.

17 Claims, 5 Drawing Sheets

UTILITY KNIFE

The invention relates generally to utility knives and more particularly to a utility knife with an improved blade change mechanism.

BACKGROUND OF THE INVENTION

Utility knives typically comprise a knife housing that is provided with a slotted aperture that receives a blade such that the blade extends from the housing. A user can grasp the housing and use the blade for cutting or slicing. When the blade becomes worn, dull or breaks the blade may be removed and replaced with a new blade.

SUMMARY OF THE INVENTION

A utility knife comprises a housing and a blade carrier located in the housing movable between a fully retracted position, a fully extended position, and an intermediate position between the fully extended position and the fully retracted position. A latch is movable with the blade carrier for locking the blade carrier in the fully retracted position and the fully extended position. The blade carrier comprises a locking tab movable between a first position where the locking tab is engaged with the blade and a second position where the locking tab is released from the blade. An actuator is mounted on the housing and is movable relative thereto between a locked position and an unlocked position. The actuator moves the locking tab from the first position to the second position when the blade carrier is in the intermediate position and the actuator is moved to the unlocked position. The latch is engageable with a holder when the blade carrier is in the intermediate position.

The housing may comprise a first housing portion and a second housing portion. An overlapping locking mechanism may be used to lock the first housing portion to the second housing portion. The blade carrier may support a blade and is supported for axial movement relative to the housing such that the blade is movable between a retracted position and an extended position. The blade carrier may comprise a locking member that moves between a first position and a second position where the locking tab is supported by the locking member. The locking member may comprise a release tab that is engaged by the actuator. The locking member may be resiliently deformed. The blade carrier may comprise a support plate that supports the blade where the locking member is formed integrally with said plate. The support plate and the locking member may be formed as a single-piece. The blade carrier may comprise a latch that locks the blade carrier in position. The latch may extend from the blade carrier and comprise a resilient member having a tab engageable with one of a plurality of stops formed on the housing for locking the blade carrier in position relative to the housing. The latch may comprise a button that extends through a slot formed in the housing. The actuator may comprise a resilient member having a first end secured to the housing and a second end extending through an opening in the housing such that a button is accessible to the user. A portion of the actuator may be disposed opposite to the release tab when the blade carrier is in the first position. The latch may comprise a tab engageable with a holder when the blade carrier is in the first position. The tab may be moved from the holder if a force is applied to the blade. The holder may comprise a depression defined by a surface terminating in a camming surface, the depression created by the surface and the camming surface having a sufficient depth to temporarily hold the blade carrier where the holder allows the tab to ride over the camming surface to move to a locked position when a force is applied to the blade. The housing comprises a blade storage compartment for holding a blade, the storage compartment comprises a movable door that allows access to a receptacle dimensioned to retain the blades and a spring retainer biased against the blades. The blade may include a notch for receiving the locking tab and a retention member for holding the blade on the plate where the retention member is wider than the notch such that the retention member cannot be inserted in the notch. A blade guide for guiding the blade into the blade carrier may be provided.

A method of operating a utility knife comprises providing a housing and a blade carrier located in and movable relative to the housing; moving the blade carrier to a blade release position; moving an actuator against a portion of the blade carrier to move a portion of the blade carrier from a first position where the portion engages a blade to a second position where the portion does not engage the blade; gripping the blade and removing the blade from the housing; releasing the actuator and allowing the portion to return to the first position.

A utility knife comprising a housing and a blade carrier located in the housing and movable between a first position, and a second position. The blade carrier comprises a support plate that supports a blade and a locking tab movable between a first position where the locking tab is engaged with a notch formed in the blade and a second position where the locking tab is released from the notch. A retention member holds the blade on the plate where the retention member is wider than the notch such that the retention member cannot be inserted into the notch. The knife may comprise a blade guide for guiding the blade between the retention member and the plate.

DETAILED DESCRIPTION OF EMBODIMENTS OF THE INVENTION

Figure 1:
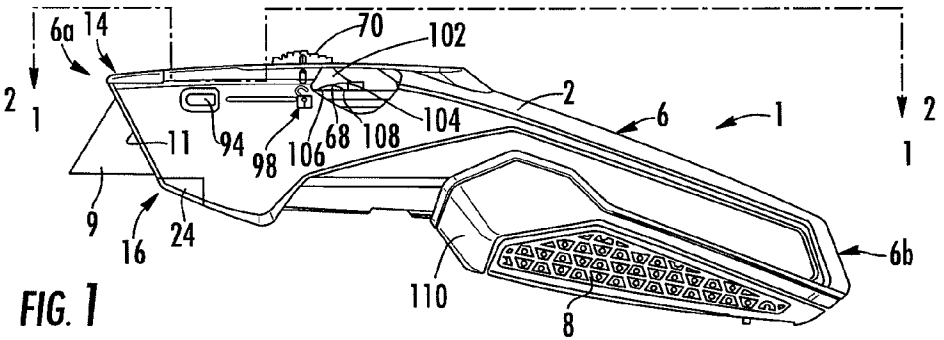
FIG. 1 is a partially cut-away side view of an embodiment of the utility knife of the invention in the unlocked position.

The utility knife is shown generally at 1 in the figures and comprises a first housing portion 2 and a second housing portion 4. The housing portions are secured to one another to form the complete knife housing 6. The knife housing 6 has a generally elongated profile that may be comfortably grasped by a user's hand with the front end or nose 6*a* of the knife extending from the user's hand. Toward the rear end or butt 6*b* of the housing 6 a hand grip 8 is formed that may be gripped during use of the knife.

The first housing portion 2 comprises a perimeter edge 10 that abuts a substantially coextensive perimeter edge 12 on the second housing portion 4 along seam S. The assembled housing 6 defines a generally open interior. A slot 11 is provided in the nose 6*a* between the first housing portion 2 and the second housing portion 4 through which a blade 9 extends during use of the knife.

Figure 2:
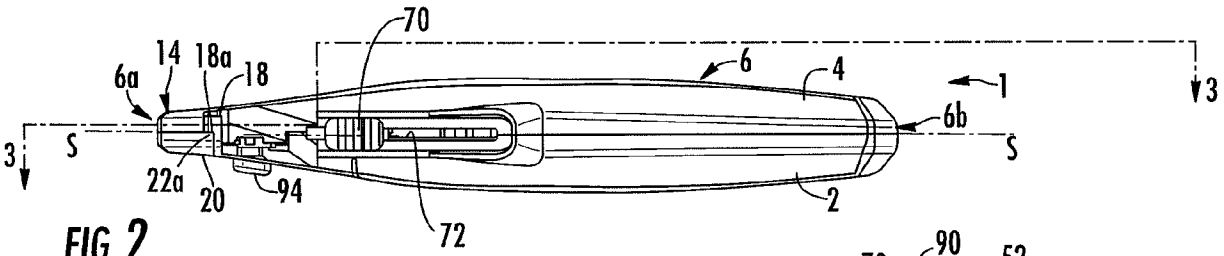
FIG. 2 is a section view taken along line 2-2 of FIG. 1.

Overlapping locking mechanisms 14 and 16 are formed at the nose 6*a* of the knife to lock the housing portions 2 and 4 together. The overlapping locking mechanisms engage one another to prevent the housing portions 2 and 4 from separating from one another at the nose 6*a* from the forces exerted on the housing 6 by the blade 9 during use of the knife. Referring to FIG. 2, overlapping locking mechanism 14 is located at the top end of the nose 6*a* and includes an engagement element 18 on housing portion 2. Engagement element 18 extends across the seam S and defines a bearing surface 18*a* that faces seam S. Housing portion 4 includes a mating engagement element 22 that includes a bearing surface 22*a* that faces opposite to and engages bearing surface 18*a*.

Figure 5:
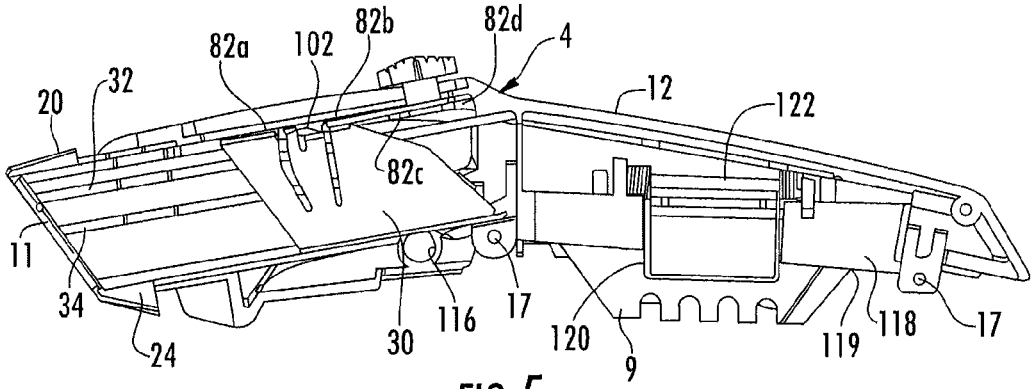
FIGS. 5 and 6 are side views of the internal structure of the utility knife of FIG. 1.
Figure 6:
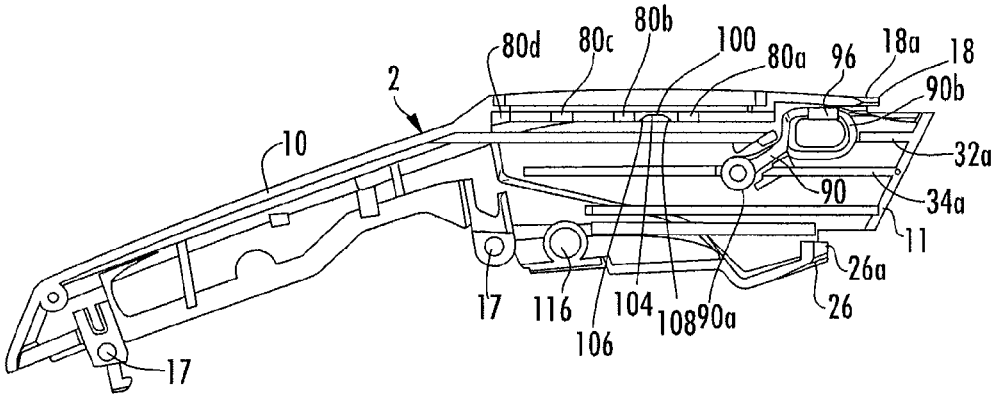
Figure 7:
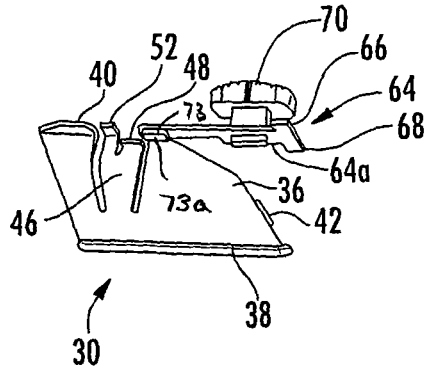
FIG. 7 is a perspective view of an embodiment of the blade carrier.
Figure 8:
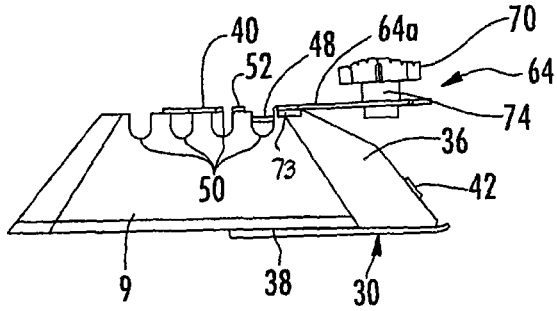
FIG. 8 is a side view of the blade carrier of FIG. 7 with the blade in a first position.
Figure 9:
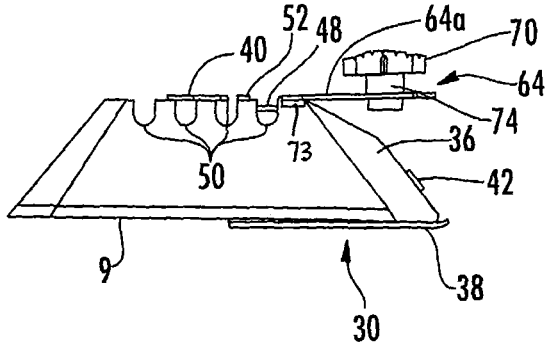
FIG. 9 is a side view of the blade carrier of FIG. 7 with the blade in a second position.
Figure 10:
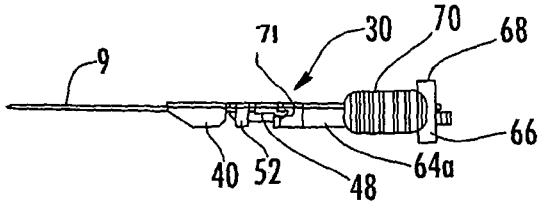
FIG. 10 is a top view of the blade carrier of FIG. 7.

A similar overlapping locking mechanism 16 is formed on the bottom end of nose 6*a*. Referring to FIGS. 1, 5 and 6, overlapping locking mechanism 16 includes an engagement element 24 on housing portion 4. Engagement element 24 extends across the seam S and defines a bearing surface 24*a* that faces seam S. Housing portion 2 includes a mating engagement element 26 that includes a bearing surface 26*a* that faces opposite to and engages bearing surface 24*a*.

To assemble the housing 6 the housing portion 2 is placed against housing portion 4 in a slightly offset position with the housing portion 2 offset toward the rear of housing portion 4. Housing portion 2 is slid in the axial direction toward the nose of housing portion 4 until bearing surface 18*a* of engagement element 18 is disposed behind bearing surface 22*a* of engagement element 22 and bearing surface 24*a* of engagement element 24 is disposed behind bearing surface 26*a* of engagement element 26. The engagement of overlapping locking mechanisms 14 and 16 prevents housing portion 2 from moving away from housing portion 4 in a transverse direction disposed generally perpendicular to seam S. Because of the mechanical interlocking of the overlapping locking mechanisms 14 and 16 the nose 6*a* cannot be pried apart by forces applied on the blade during use of the knife.

With the housing portions 2 and 4 positioned with the overlapping locking mechanisms 14 and 16 in the engaged position, the housing portions are then secured to one another. In one embodiment the housing portions 2 and 4 are secured to one another by screws or other fasteners that engage receptacles 17 such that the housing portions may be separated from one another. The housing portions 2 and 4 may also be secured together by welding adhesive or the like such that the housing portions cannot be separated. Because the housing portions 2 and 4 need not be separated from one another during normal use of the knife, any permanent or semi-permanent securing mechanism may be used to secure the housing portions together although use of a releasable fastener allows the housing to be opened for maintenance.

Referring to FIGS. 7 through 10, a blade carrier 30 for supporting axial movement of a blade between the retracted and extended positions relative to the housing is provided. The blade carrier 30 comprises a relatively flat support plate 36 that rides on first support surface 32 and second support surface 34 formed on housing portion 2. First and second support surfaces 32, 34 extend along the axial direction of travel of the blade carrier 30 to support the blade carrier 30 as it moves relative to the housing 6. A gap G is provided in the support surfaces 32, 34 as will herein after be described. The plate 36 is dimensioned and shaped to hold a blade 9 between the outwardly extending flanges 38 and 40. A stop 42 is formed along the back edge of the plate 36 to engage the back edge of the blade 9 such that the blade is not inserted beyond the end of carrier 30. Support surfaces 32*a* and 34*a* are provided in housing 2 that support and retain the blade against blade carrier 30 such that the blade is trapped between the carrier and the support surfaces 32*a* and 34*a*.

A locking member 46 extends from the plate 36 and is movable relative to plate 36 such that it can move between a blade retaining position and a blade release position. In the illustrated embodiment the plate 36 and locking member 46 are formed of a single-piece unitary member of resilient material such as plastic or steel. However, a separate locking member 46 may be connected to plate 36 such as by a hinge and biased by a separate resilient member such as a spring. Locking member 46 comprises a locking tab 48 located adjacent the top edge of plate 36 that releasably engages one of a plurality of notches 50 formed in the top edge of the utility blade 9 to retain the blade on carrier 30 and to properly position the blade 9 on the carrier 30 in one of a plurality of positions. Locking member 46 also includes a release tab 52 that extends over the top edge of blade 9 and that may be engaged by an to move the locking member 46 to disengage the locking tab 48 from the notches 50 to release the blade 9.

The blade carrier 30 also includes a latch 64 that locks the blade carrier in a fully retracted position, a fully extended position or one of a plurality of partially extended positions. The latch 64 extends from the top of the plate 36 and comprises a resilient member 64*a* that extends along the direction of travel of the blade carrier 30. The latch 64 comprises tabs 66 and 68 that extend toward the first housing portion 2 and the second housing portion 4, respectively. A button 70 extends through a slot 72 formed in the housing 6 such that when the user moves the button 70 in slot 72 the carrier 30 is reciprocated in housing 6 along surfaces 32, 34. The button 70 is connected to the resilient member 64*a* by neck 74 that is long enough to allow the button 70 to be depressed such that the resilient member 64*a* can be deformed from the locking position shown in the figures to a release position as will hereinafter be described.

Figure 11:
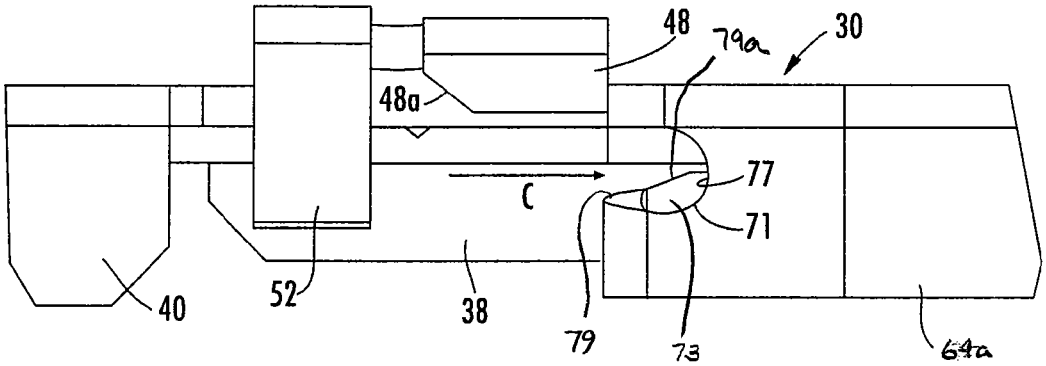
FIG. 11 is a detailed top view of the blade carrier of FIG. 10.
Figure 12:
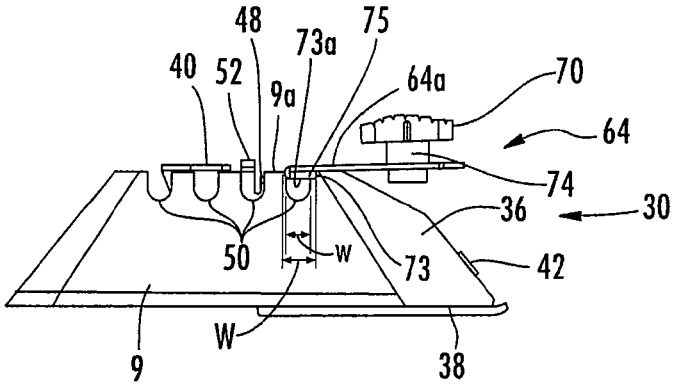
FIG. 12 is a side view of the blade carrier of FIG. 7 showing an alignment of the blade relative to the blade carrier.
Figure 13:
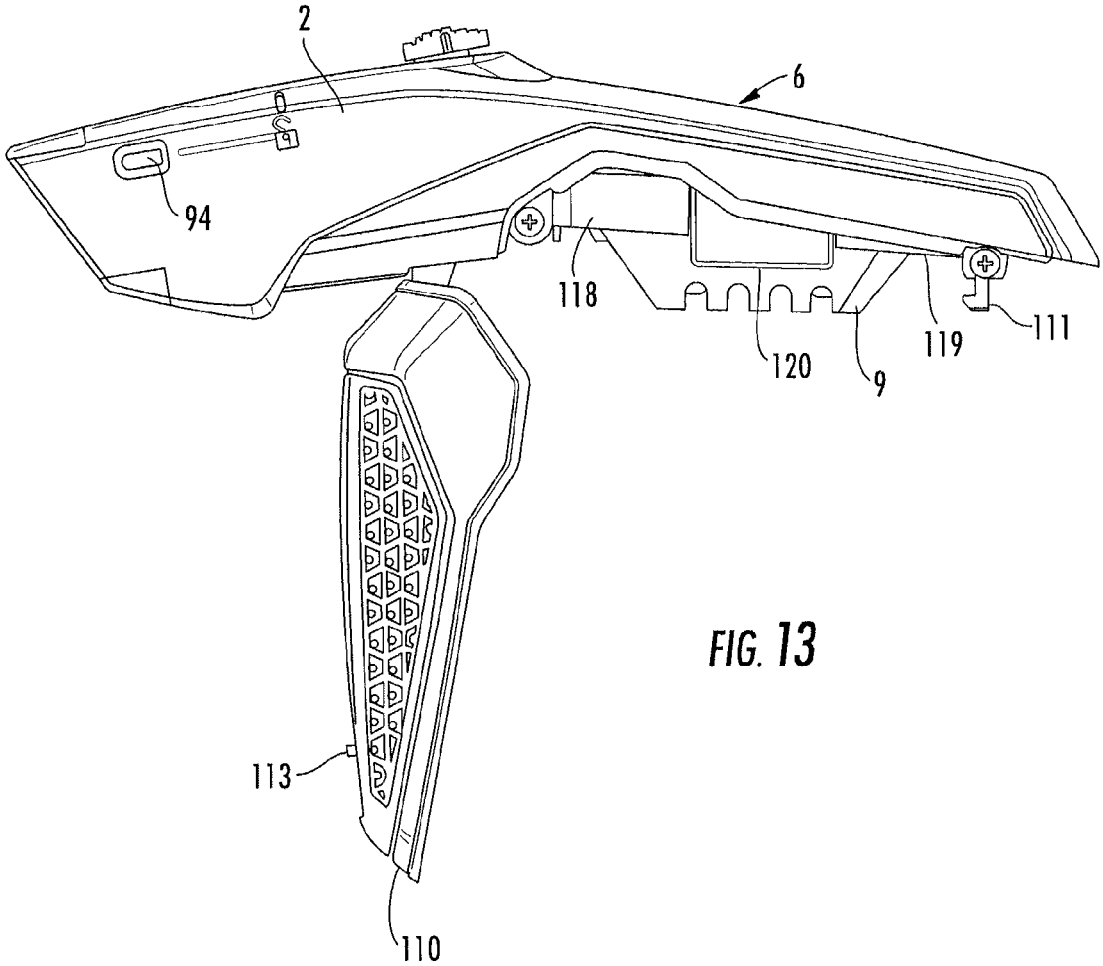
FIG. 13 is a side view of the knife of FIG. 1 in an open position.

Referring to FIGS. 11, 12 and 13 a blade guide 71 and retention member 73 are formed at the end of member 64*a*. In the illustrated embodiment the blade guide 71 and retention member 73 are formed by bending an end portion 75 of member 64*a* back onto itself to create a relatively thickened area where the bottom 73*a* of retention member 73 extends below the upper edge 9*a* of blade 9. While the blade guide 71 and retention member 73 are shown as part of member 64*a* these components may formed as separate elements attached to the upper edge of blade guide 30.

Blade guide 71 is formed as a notch 77 in the end of member 64*a* and notch 79 in the end of member 75. When a blade 9 is inserted into the blade guide 30 in the direction of arrow C, the upper edge 9*a* of the blade 9 engages notch 77 and notch 79 such that the upper end of blade 9 is forced toward the plate 36. Notch 79 may be formed with an edge 79*a* that is angled toward plate 36 in the direction of insertion such that the edge 79*a* acts as a camming surface to push blade 9 toward plate 36. Blade guide 71 captures the leading edge of blade 9 to prevent the blade from accidentally missing the blade guide as the blade is inserted into the knife through slot 11. Locking tab 48 includes a chamfered leading edge 48*a* to allow the blade to move past the leading edge of the locking tab when the blade is inserted into the blade carrier. The chamfered edge 48*a* is disposed at an angle relative to direction C such that the blade, if it strikes locking tab 48, will move the locking tab out of interference with the blade and allow the blade to slide past the locking tab 48.

Retention member 73 holds the blade 9 in position against plate 36 and is dimensioned such that it has a width W that is greater than the width w of the notches 50 on blade 9. The retention member 73 is spaced from plate 36 a distance slightly greater than the thickness of a blade such that a blade can be inserted between retention member 73 and plate 36 with retention member 73 holding the blade against plate 36. Retention member 73 prevents a blade 9 from being inserted into the knife in a position where the user believes the blade to be locked on carrier 30 when the blade is actually in an unlocked position. If a retention member is used to hold the blade against plate 36 that is smaller than the notches 50, the user can insert a blade such that the retention member is engaged in one of notches 50. In such a situation, the blade is not properly seated against the plate 30 and is not locked in position by locking tab 48; however, when the user pulls on the blade 9, the blade feels as if it is locked in position because the retention member is caught on one of notches 50. During use the blade can pull away from the retention member and become loose.

With the retention member 73 having a width that is greater than the width of the notches 50 such "false" locking is prevented. When a blade is seated against plate 36 blade 9 is disposed behind retention member 73 such that blade 9 is held against plate 36. Because retention member 73 is wider than notches 50, even if one of notches 50 and retention member 73 become aligned during insertion of the blade (as shown in FIG. 12) notch 50 cannot pass over retention member 73 such that the blade is maintained in position against plate 36. If a force is applied against the blade 9 when it is such a position the blade may only shift relative to blade carrier 30 such that one of notches 50 is engaged by locking tab 48. If the blade 9 is inserted into the knife such that the blade is not properly seated on blade carrier 30, retention member 73 cannot engage the notches 50 and false locking is prevented.

The blade guide 71 functions to ensure that a blade 9 inserted into the knife will be forced into proper alignment on the blade carrier 30. The width of retention member 73 prevents inadvertent engagement between the engagement member and any one of notches 50 to prevent false locking of the blade.

A series of stops are provided in the housing portion to fix the position of the carrier 30 in housing 6. Housing portion 2 includes a plurality of downwardly recesses 80*a*, 80*b*, 80*c* and 80*d* that extend along the axial length of the housing portion adjacent to nose 6*a* and are located along side of the latch 64. The recesses 80*a*, 80*b*, 80*c* and 80*d* are dimensioned such that the tab 66 can be located in any one of the recesses. Housing portion 4 includes a plurality of recesses 82*a*, 82*b*, 82*c* and 82*d* that extend along the axial length of the housing portion 4 and are located along side of the latch 64 and are positioned opposite to recesses 80*a*, 80*b*, 80*c* and 80*d*, respectively. The recesses 82*a*, 82*b*, 82*c* and 82*d* are dimensioned such that the tab 68 can be located in any one of the recesses. The walls of the recesses act as stops. When the tabs 66, 68 are located in the selected recesses the engagement of the tabs with the walls of the recesses prevents the blade carrier 30 from moving relative to the housing 6.

When the tabs 66, 68 are in recesses 80*a*, 82*a* the blade is in the fully extended position and when the tabs 66, 68 are in recesses 80*d*, 82*d* the blade is in the fully retracted position. At least one pair of intermediate recesses may be provided where the blade is extended but is in less than the fully extended position. By depressing button 70 and deforming latch 64 downward the tabs 66 and 68 are removed from locking engagement with the recesses allowing the blade carrier 30 to be repositioned in the housing 6.

To move the blade carrier 30 and adjust its position in the housing 6, the user pushes down on button 70 to depress the latch 64 and force tab 66 out of recess 80*a*, 80*b*, 80*c* or 80*d* and tab 68 out of recess 82*a*, 82*b*, 82*c* or 82*d*. Once the tabs are removed from the recesses, and while the button 70 is depressed, the user can push on the button 70 to adjust the position of the blade carrier 30 in the housing 6 and the length of blade 9 extending from the housing 6.

The first housing portion 2 includes an actuator 90 located along the path of travel of blade carrier 30. In the illustrated embodiment the actuator 90 comprises a resilient member having one end 90*a* secured to the housing portion 2 and the second end 90*b* extending through an opening 92 in the housing portion 2 such that a button 94 is accessible to the user. The user can push on the exposed button 94 to deform the actuator 90 and move the second end 90*b* toward the interior of the housing to an "unlocked" position. Because the actuator 90 is made of a resilient material such as plastic or spring steel it returns to the starting "locked" position when the user releases the button. A finger 96 extends from the second end 90*b* of the actuator 90 and is positioned such that it is disposed opposite to the release tab 52 on blade carrier 30 when the latch blade carrier 30 is in the blade release position. In this position the second end of actuator 90 is positioned opposite locking member 46 and locking member 46 is position in the gap G formed in supports 32 and 34. When the blade carrier 30 is in the blade release position the blade may be removed from the blade carrier.

Figure 3:
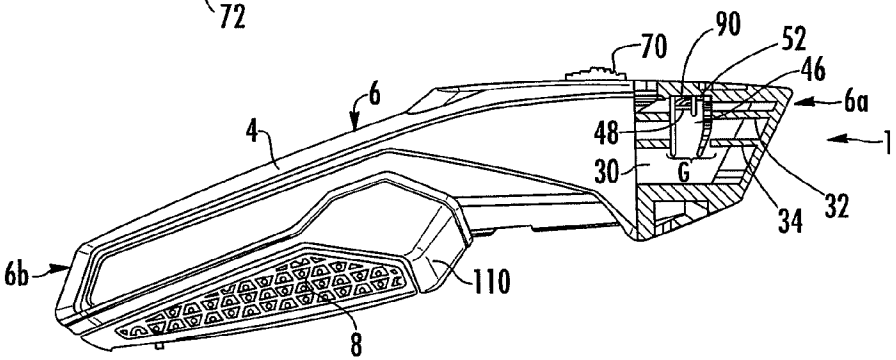
FIG. 3 is a section view taken along line 3-3 of FIG. 2.

To remove the blade, the user moves the blade carrier 30 to the blade release position (shown in FIGS. 1, 2 and 3) by moving button 70. The blade release position may be identified to the user by indicia 98. When the blade carrier 30 is in the blade release position, the release tab 52 on blade carrier 30 is positioned behind finger 96 on actuator 90. The user presses the exposed button 94 to deform actuator 90 and force the finger 96 against release tab 52 of blade carrier 30. Finger 96 pushes against the release tab 52 to deform the locking member 46 and to move the locking tab 48 out of the notch 50 in the blade 9. Because locking member 46 is positioned in gap G, clearance is provided that allows locking member 46 to move out of engagement with the blade and into gap G. The blade 9 may be gripped by the user and repositioned on blade carrier 30 or removed and a new blade inserted into the housing on blade carrier 30. The button 94 is released allowing the actuator 90 and locking member 46 to return to the locked position where locking tab 48 is engaged with one of the notches 50 on the blade 9.

Figure 4:
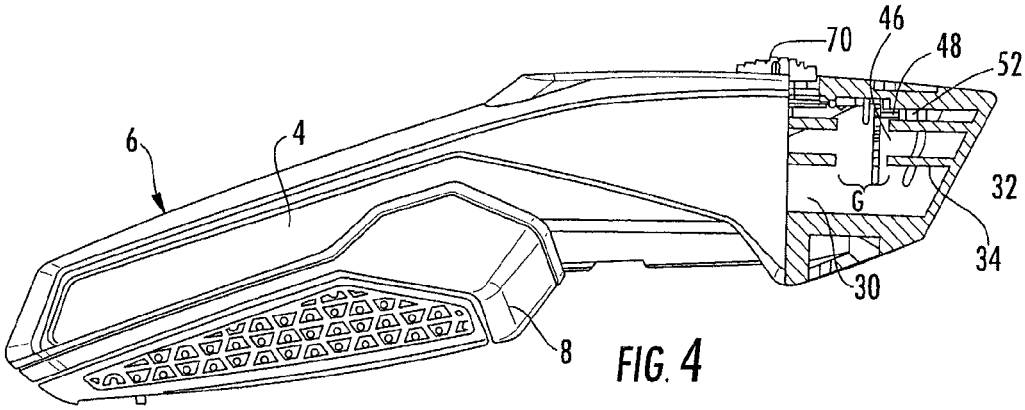
FIG. 4 is a section view similar to FIG. 3 of the utility knife in the locked position.

If the blade carrier 30 is in any position other than the blade release position (as shown in the fully extended position in FIG. 4), the blade 9 cannot be removed because the finger 96 of actuator 90 is not aligned with the release tab 52. If the user depresses button 94, finger 96 will either contact flange 40 or it will not contact the blade carrier at all. Further, locking member 46 is not located in gap G and is instead positioned in front of supports 3 and 32. The clearance between the supports 32 and 34 and the locking member 46 is insufficient to allow the locking member to move enough to be disengaged from notch 55 in blade 9. In any position except the blade release position, locking member 46 cannot be not moved to the unlocked position, and locking tab 52 remains engaged with the notch 50 such that the blade 9 is held firmly in place on blade carrier 30.

A safety mechanism is provided to prevent the user from using the knife when the blade carrier 30 is in the blade release position to prevent the blade from separating from the housing 6 during use of the knife. When the blade carrier 30 is in the blade release position, the tabs 66 and 68 are located in holders 100 and 102 formed on housing portions 2 and 4 (FIGS. 1, 5 and 6). The holders 100 and 102 are positioned such that the blade 9 is partially extended from the housing 6. The blade release position is an intermediate position between the fully extended and fully retracted position. As a result, the blade cannot be inadvertently removed when the blade is in the fully extended position (the most common use position) but the blade extends from the housing such that it can be gripped and removed by a user. The holders 100 and 102 each have a flat surface 104 that terminates in angled camming surfaces 106 and 108. The depression created by surfaces 106 and 108 and flat surface 104 has a sufficient depth that it will locate and temporarily hold the blade carrier 30 in the blade release position allowing the user to depress the push button 94 and remove and replace the blade 9. However, the depression is shallow enough that should a user apply a predetermined force to the blade 9 when the blade carrier 30 is in the release position, the tabs 66 and 68 will ride over camming surfaces 106 or 108 allowing the blade carrier 30 to move to either of the adjacent locked positions. This prevents a user from using the knife when the blade carrier is in the blade release position to prevent the blade from being inadvertently removed from the housing 6 during use of the knife.

The knife is also provided with a blade storage compartment for holding new and/or used blades. Referring to FIGS. 5 and 13, the storage compartment comprises a movable door 110 that forms part of handle 11. A hinge defined by extending hinge pins that are trapped in bearing recesses 116 formed in the first and second housing portions such that door 110 can pivot relative to the housing portions but cannot be removed. Opening the door 110 allows access to the interior of the housing 6. Located within the housing 6 is a blade holder 118 defining a receptacle 119 dimensioned to receive and retain a plurality of blades 9. The opening in receptacle 119 faces the door such that when the door is opened access to the blades 9 is provided. In one embodiment the blade holder 118 comprises a separate component such as a molded plastic compartment that is trapped between the housing portions 2 and 4 in the assembled housing 6. A spring retainer 120 is mounted on a shaft 122 such that the spring retainer is biased against the blades 9 in blade holder 118 to trap the blades against a wall of the blade holder such that the blades will not fall from the compartment when the door is opened. Door 110 may be held in the closed position by a latch 111 that engages a movable strike plate on the door 110.

Specific embodiments of an invention are disclosed herein. One of ordinary skill in the art will recognize that the invention has other applications in other environments. Many embodiments are possible. The following claims are in no way intended to limit the scope of the invention to the specific embodiments described above.

The invention claimed is:

1. A utility knife comprising:

a housing;

a blade;

a blade carrier located in said housing and movable in an axial direction between a fully retracted position, a fully extended position, and an intermediate position between the fully extended position and the fully retracted position, a latch movable with said blade carrier for locking said blade carrier in said fully retracted position and said fully extended position; the blade carrier comprising a locking tab movable between a first position where the locking tab is engaged with a notch on a top edge of the blade and a second position where the locking tab is released from the notch on the blade, the notch having a first width in the axial direction; an actuator mounted on the housing and movable relative thereto between a locked position and an unlocked position, said actuator moving said locking tab from the first position to the second position when the blade carrier is in the intermediate position and the actuator is moved to the unlocked position, thereby allowing removal of the blade from the blade carrier in the intermediate position;

a retention member disposed to engage a first face of the blade adjacent the top edge to hold an opposite face of the blade against said blade carrier, said retention member having a second width in the axial direction that is greater than the first width such that said retention member cannot be inserted into said notch in a direction transverse to the axial direction.

2. The utility knife of claim 1 wherein said blade carrier comprises a locking member movable between a first position and a second position, said locking tab being supported by said locking member.

3. The utility knife of claim 2 wherein said locking member comprises a release tab that is engaged by the actuator.

4. The utility knife of claim 3 wherein engagement of the release tab by the actuator moves the locking member.

5. The utility knife of claim 4 wherein the locking member is resiliently deformable.

6. The utility knife of claim 2 wherein the blade carrier comprises a support plate that supports the blade and said locking member is formed integrally with said support plate.

7. The utility knife of claim 6 wherein the support plate and the locking member are formed as a single-piece.

8. The utility knife of claim 1 wherein the latch extends from the blade carrier and comprises a resilient member having a tab engageable with one of a plurality of stops formed on the housing for locking the blade carrier in position relative to the housing.

9. The utility knife of claim 8 wherein said latch further comprises a button that extends through a slot formed in the housing.

10. The utility knife of claim 1 wherein the actuator comprises a resilient member having a first end secured to the housing and a second end extending through an opening in the housing to form a button.

11. The utility knife of claim 3 wherein a portion of the actuator is disposed opposite to the release tab when the blade carrier is in the intermediate position.

12. The utility knife of claim 1 comprising a holder engaged by the latch when the blade carrier is in the intermediate position, said latch being movable from said holder when a force is applied to the blade.

13. The utility knife of claim 12 wherein said holder comprises a depression defined by a surface terminating in a camming surface, the depression created by the surface and the camming surface having a sufficient depth to temporarily hold the blade carrier, the holder allowing the latch to ride over the camming surface to move to a locked position when said force is applied to the blade.

14. The utility knife of claim 1 wherein said housing comprises a blade storage compartment for holding a blade, the storage compartment comprising a movable door that allows access to a receptacle dimensioned to retain said blade and a spring retainer biased against the blade.

15. The utility knife of claim 1 further including a blade guide for guiding said blade into said blade carrier.

16. The utility knife of claim 1 further including a blade guide for guiding said blade between said retention member and said plate.

17. A utility knife comprising:

a housing;

a blade;

a blade carrier located in said housing and movable between a fully retracted position, a fully extended position, and an intermediate position between the fully extended position and the fully retracted position, a latch movable with said blade carrier for locking said blade carrier in said fully retracted position and said fully extended position; the blade carrier comprising a locking tab movable between a first position where the locking tab is engaged with the blade and a second position where the locking tab is released from the blade; an actuator mounted on the housing and movable relative thereto between a locked position and an unlocked position, said actuator moving said locking tab from the first position to the second position when the blade carrier is in the intermediate position and the actuator is moved to the unlocked position, thereby allowing removal of the blade from the blade carrier in the intermediate position;

wherein said latch is engageable with a holder when the blade carrier is in the intermediate position;

the holder comprising a depression defined by a surface terminating in a camming surface, the depression created by the surface and the camming surface having a sufficient depth to temporarily hold the blade carrier when the blade carrier is in the intermediate position and the latch is in a seated position on the surface, the holder allowing the latch to ride over the camming surface to move from the seated position to a locked position when a force is applied to the blade.

* * * * *